US005689899A

United States Patent [19]

Szenker et al.

[11] Patent Number: 5,689,899

[45] Date of Patent: Nov. 25, 1997

[54] METHOD FOR DRYING AUTOMOBILE PAINTS

[75] Inventors: Ber Szenker, Munich; Johann Benning, Anzing, both of Germany

[73] Assignee: Bayerische Motoren Werke Aktiengesellschaft, Munich, Germany

[21] Appl. No.: 637,627

[22] PCT Filed: Oct. 21, 1994

[86] PCT No.: PCT/EP94/03467

§ 371 Date: Apr. 29, 1996

§ 102(e) Date: Apr. 29, 1996

[87] PCT Pub. No.: WO95/12102

PCT Pub. Date: May 4, 1995

[30] Foreign Application Priority Data

Oct. 28, 1993 [DE] Germany ..... 43 36 857.3

[51] Int. Cl.[6] ..... F26B 3/34

[52] U.S. Cl. ..... 34/270; 34/307

[58] Field of Search ..... 34/270, 307, 381, 34/442, 497, 562; 432/59; 219/202, 388, 405, 492, 497, 501, 502; 392/411, 414, 417, 424

[56] References Cited

U.S. PATENT DOCUMENTS

| | | | |
|---|---|---|---|
| 4,416,068 | 11/1983 | Nilsson et al. | 34/267 |
| 4,621,187 | 11/1986 | Petro, Jr. | 392/414 |
| 4,635,381 | 1/1987 | Hubbert | 34/233 X |
| 4,665,626 | 5/1987 | Berkmann et al. | 34/267 |
| 4,670,994 | 6/1987 | Takata et al. | 34/270 X |
| 4,785,552 | 11/1988 | Best | 34/418 |
| 4,907,533 | 3/1990 | Nelson et al. | 34/270 |
| 5,164,571 | 11/1992 | Asaoka et al. | 219/502 |

FOREIGN PATENT DOCUMENTS

| | | |
|---|---|---|
| 0 203 377 | 12/1986 | Germany . |
| WO 96/15415 | 5/1996 | WIPO . |

*Primary Examiner*—John M. Sollecito
*Assistant Examiner*—Steve Gravini
*Attorney, Agent, or Firm*—Evenson, McKeown, Edwards & Lenahan, P.L.L.C.

[57] ABSTRACT

In order to produce an optimally smooth paint surface in automobiles, the heating phase of the drying process is interrupted when an object temperature of about 65° C. is reached. This object temperature is then held for at least two and at most three and a half minutes. Then the heating phase is continued until the holding temperature is reached.

19 Claims, 2 Drawing Sheets

METHOD FOR DRYING AUTOMOBILE PAINTS

BACKGROUND AND SUMMARY OF THE INVENTION

The invention relates to a method for drying painted automobile bodies or their parts. The auto bodies or parts are painted with one-pack paint using a combined infrared/air-circulation oven or a pure infrared oven, with a heating period being followed by a holding period at the temperature reached for drying.

In manufacturing automobiles, an effort is made during painting to achieve a paint structure that is as flat as possible. This applies both to the application of the main coat (top coat) as well as any necessary application of refinishing paint. Without special measures, such as turning the painted body around its lengthwise axis during the drying process, providing large paint layer thicknesses, as well as multiple coat layers, it has not been possible thus far to achieve a completely flat paint structure.

The goal of the present invention is to provide a remedy in this regard and to propose a method for drying painted vehicle bodies or parts thereof with which a nearly flat paint structure is achieved without additional expense.

This goal is achieved according to the invention by a method for drying painted automobile bodies or their parts. The auto bodies or parts are painted with one-pack paint using a combined infrared/air-circulation oven or a pure infrared oven, with a heating period being followed by a holding period at the temperature reached for drying. A pure infrared oven is used exclusively for heating, in which, when the paint to be dried has reached a temperature of at least 50° C. and at most 80° C., the heating phase is interrupted for at least two minutes.

Surprisingly it has been found that when heating is interrupted, and relatively independently of the type of paint used, and the temperature reached at the time of the interruption is then held, an optimum surface structure for the paint film can be achieved. Evidently, the interruption of the heating or the provision of a longer holding time in a low paint viscosity range gives the paint film sufficient time to run. The paint has not yet had a chance to react chemically at this point. It is important when drying paint by applying heat that only infrared radiators be used and that drying not be performed in circulating air alone. During the holding time that follows heating, drying can be performed using circulating air alone or in combination with infrared heaters.

An optimally smooth paint surface can be achieved extremely economically by the method according to the invention.

Further advantages are described as follows. As a result of the higher end temperatures used for drying, the drying time is shortened. This results in savings in the length of the driers and, hence, in the space required in buildings. In addition, the previously obligatory evaporation areas can be eliminated.

DETAILED DESCRIPTION OF THE DRAWINGS

Two typical temperature curves will now be described in greater detail. In the first illustration of FIG. 1, the temperature is plotted as a function of drying time, and the set temperature curve for an automobile body painted with a top coat is shown as well. The temperatures shown relate to object temperature, in other words, the temperature of the painted surface. This is measured with thermocouples or with a pyrometer.

As can be seen, the heating phase begins at ambient temperature and continues until a temperature of about 65° C. is reached.

When this temperature is reached, the heating process is interrupted. This means that the temperature that has been reached is maintained for about three minutes. Then, the heating phase resumes. The temperature rise during heating proceeds at 20° C. per minute.

When a temperature of about 155° C. is reached, the holding time begins. After a maximum of thirteen minutes (heating time plus holding time), the applied paint film will be hard. In one extreme case it was found that the paint film had already hardened after only seven minutes, yet also met all of the chemical and technical requirements. Despite the extremely short heating times used, there were no bubbles.

Figure 1:
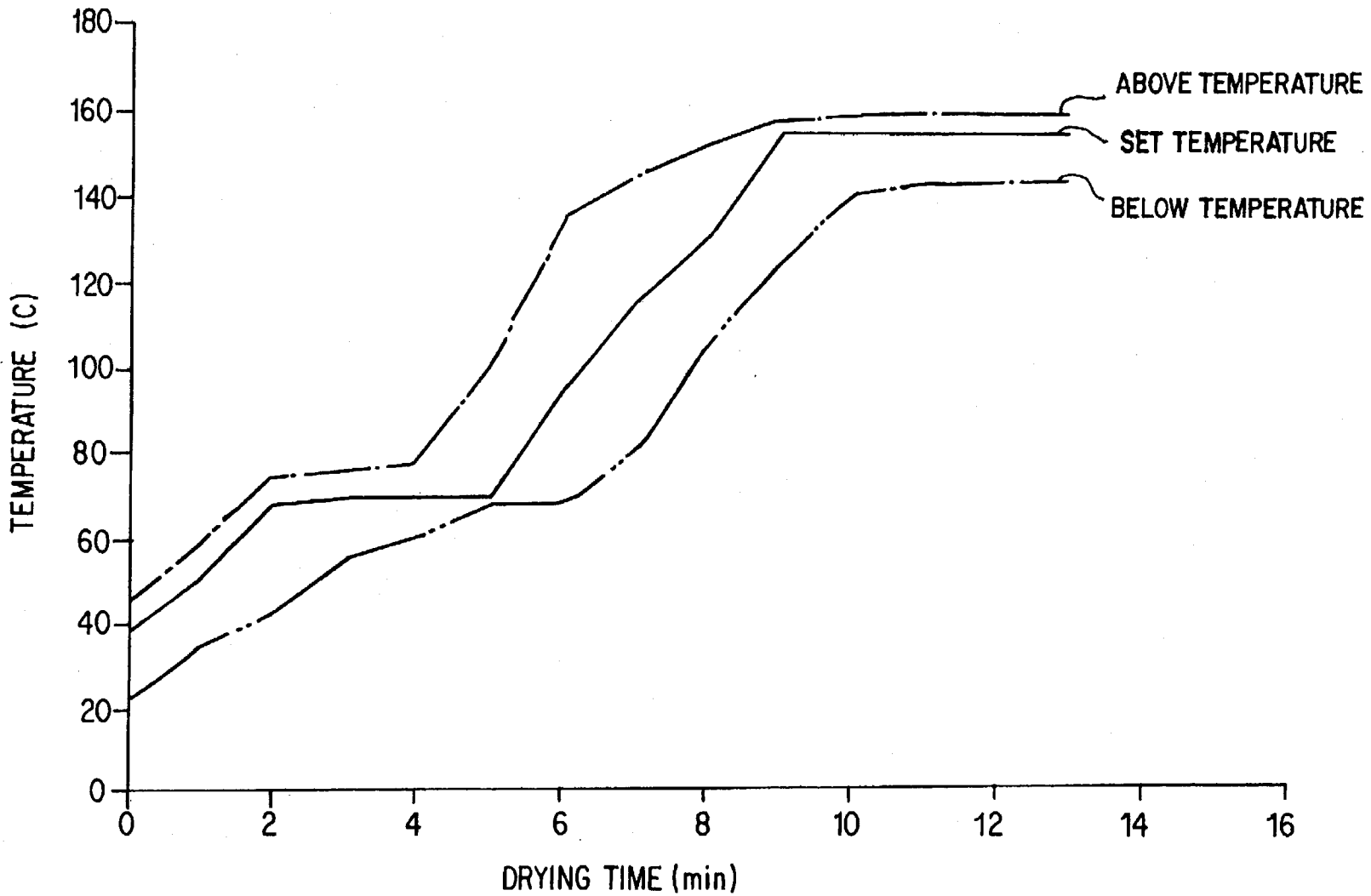
FIG. 1 is a graphical illustration of the temperature curves for a top coat according to the present invention.

FIG. 1 also shows two temperature curves, one of which is above the set temperature curve and the other below it. These are marginal temperature curves that must not be undershot or exceeded if the result according to the invention is to be achieved.

Figure 2:
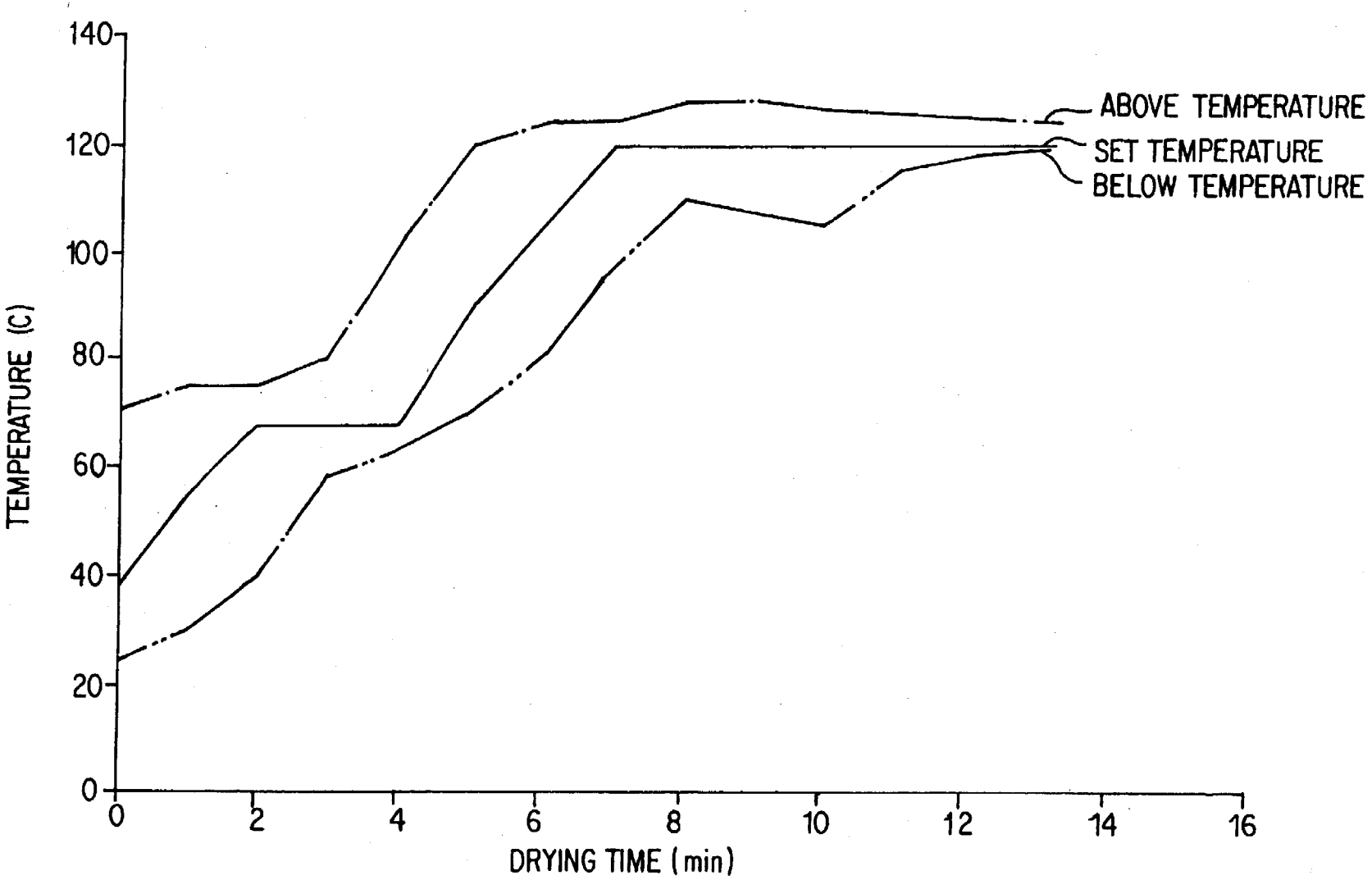
FIG. 2 is a graphical illustration of the temperature curves similar to FIG. 1 but for a catalyzed refinishing paint.

FIG. 2 shows the same information as in FIG. 1, with the difference being that this graph is for a catalyzed refinishing paint whose drying time begins when an object temperature of about 120° C. is reached. Otherwise, the statements made with respect to FIG. 1 apply here as well.

It can generally be said that with the test panels used, layer thickness differences in the applied paint in the range of from 20 to 40 μm have no significant influence on the drying time or drying temperature.

We claim:

1. A method for drying painted automobile bodies or parts thereof which are painted with a one-pack paint in a method having a heating period followed by a holding period at a temperature reached for drying, the method comprising the steps of:

performing a heating phase exclusively using a pure infrared oven for the paint to be dried; and interrupting the heating phase for at least two minutes when the paint to be dried reaches a temperature of at least 50° C. and at most 80° C.

2. The method according to claim 1, wherein the interrupting step has a duration of a maximum of four minutes.

3. The method according to claim 1, wherein the temperature reached in the heating phase is maintained during the interrupting step.

4. The method according to claim 2, wherein the temperature reached in the heating phase is maintained during the interrupting step.

5. The method according to claim 1, wherein the heating phase is performed before and after the interrupting step at a heating rate of at least 15° C. per minute until the drying temperature is reached.

6. The method according to claim 2, wherein the heating phase is performed before and after the interrupting step at a heating rate of at least 15° C. per minute until the drying temperature is reached.

7. The method according to claim 3, wherein the heating phase is performed before and after the interrupting step at a heating rate of at least 15° C. per minute until the drying temperature is reached.

8. The method according to claim 4, wherein the heating phase is performed before and after the interrupting step at a heating rate of at least 15° C. per minute until the drying temperature is reached.

9. The method according to claim 1, wherein when the paint is a catalyzed refinishing paint, the interrupting step is performed at a temperature of the paint to be dried of from 60° C. to 70° C. for two minutes; and wherein a holding time begins when the paint to be dried reaches a temperature of 125° C.

10. The method according to claim 2, wherein when the paint is a catalyzed refinishing paint, the interrupting step is performed at a temperature of the paint to be dried of from 60° C. to 70° C. for two minutes; and wherein a holding time begins when the paint to be dried reaches a temperature of 125° C.

11. The method according to claim 3, wherein when the paint is a catalyzed refinishing paint, the interrupting step is performed at a temperature of the paint to be dried of from 60° C. to 70° C. for two minutes; and wherein a holding time begins when the paint to be dried reaches a temperature of 125° C.

12. The method according to claim 5, wherein when the paint is a catalyzed refinishing paint, the interrupting step is performed at a temperature of the paint to be dried of from 60° C. to 70° C. for two minutes; and wherein a holding time begins when the paint to be dried reaches a temperature of 125° C.

13. The method according to claim 1, wherein when the paint is a top coat, the interrupting step begins at a temperature of the drying paint of from 60° C. to 70° C. for three minutes; and wherein a holding time begins when the paint to be dried reaches a temperature of 155° C.

14. The method according to claim 2, wherein when the paint is a top coat, the interrupting step begins at a temperature of the drying paint of from 60° C. to 70° C. for three minutes; and wherein a holding time begins when the paint to be dried reaches a temperature of 155° C.

15. The method according to claim 3, wherein when the paint is a top coat, the interrupting step begins at a temperature of the drying paint of from 60° C. to 70° C. for three minutes; and wherein a holding time begins when the paint to be dried reaches a temperature of 155° C.

16. The method according to claim 5, wherein when the paint is a top coat, the interrupting step begins at a temperature of the drying paint of from 60° C. to 70° C. for three minutes; and wherein a holding time begins when the paint to be dried reaches a temperature of 155° C.

17. The method according to claim 1, wherein said pure infrared oven is formed using a combined infrared/air-circulation oven having an air-circulating portion thereof switched-off.

18. The method according to claim 17, wherein during the interrupting step, the air-circulation portion is switched-on.

19. A method for drying painted automobile bodies or parts thereof which are painted with a one-pack paint in a method having a heating period followed by a holding period at a temperature reached for drying, the method comprising the steps of:

performing a heating phase exclusively using a pure infrared oven for the paint to be dried; and interrupting the heating phase for at least two minutes when the paint to be dried reaches a temperature of at least 50° C. and at most 80° C., before continuing the heating phase to a higher temperature.

* * * * *